United States Patent [19]

Abell

[11] Patent Number: 4,493,089

[45] Date of Patent: Jan. 8, 1985

[54] ELECTRIC FURNACE INSULATION

[75] Inventor: R. Bruce Abell, Algonquin, Ill.

[73] Assignee: Refractory Poroducts Co., Elgin, Ill.

[21] Appl. No.: 477,123

[22] Filed: Mar. 21, 1983

[51] Int. Cl.[3] ..... H05B 3/66; F27D 1/00

[52] U.S. Cl. ..... 373/130; 373/137

[58] Field of Search ..... 373/130, 137, 119; 432/248

[56] References Cited

U.S. PATENT DOCUMENTS 4,088,825 5/1978 Carr .
4,341,916 7/1982 Byrd, Jr. et al. .
4,346,252 8/1982 Walton et al. .

FOREIGN PATENT DOCUMENTS 1091227 4/1955 France ..... 373/130
1499107 1/1978 United Kingdom ..... 373/130

*Primary Examiner*—Roy N. Envall, Jr.
*Attorney, Agent, or Firm*—Fitch, Even, Tabin & Flannery

[57] ABSTRACT

A kit is provided that is especially designed for relining electric furnaces of circular cross section and relatively standard dimensions. Prefabricated rings of ceramic fibers bonded together with an inorganic binder form integral, rigid bodies that can be easily handled. Some rings are provided with protruding hangers at predetermined desired locations, spaced around the interior circumference of the ring. The hangers are each formed with an upturned hook at one end of a short intermediate section that supports the heating ribbon and with a straight, elongated section at the other end thereof which is oriented at an angle of between about 115° and about 155° thereto. The elongated ends fit into downwardly inclined holes which are correspondingly oriented at an angle between 25° and 65° to the interior, vertical, circumferential wall of the ring. Additional, rigid, ceramic-fiber, spacer rings are located above or below the hanger-carrying ring, and a relatively thin sealing batt of flexible refractory fiber felt is preferably located at the interface between adjacent rings. Optional ceramic spacers may be installed below each of the hangers.

18 Claims, 4 Drawing Figures

Fig. 1.
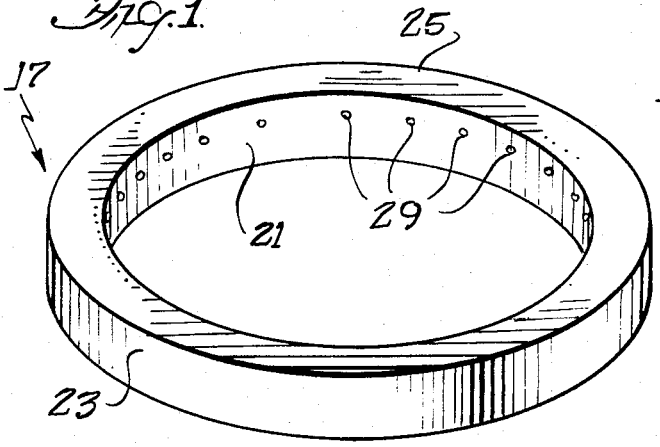
Fig. 2.
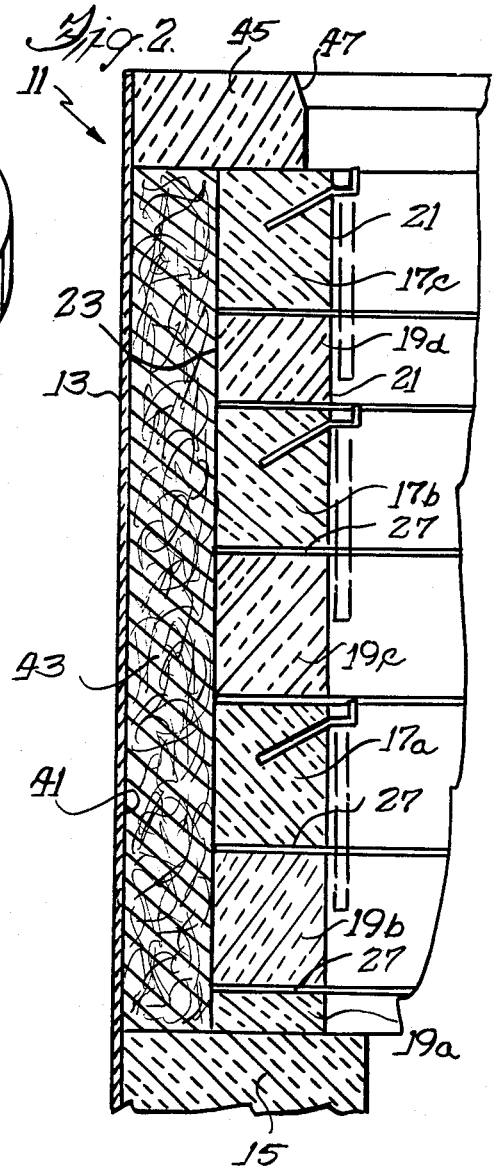
Fig. 3.
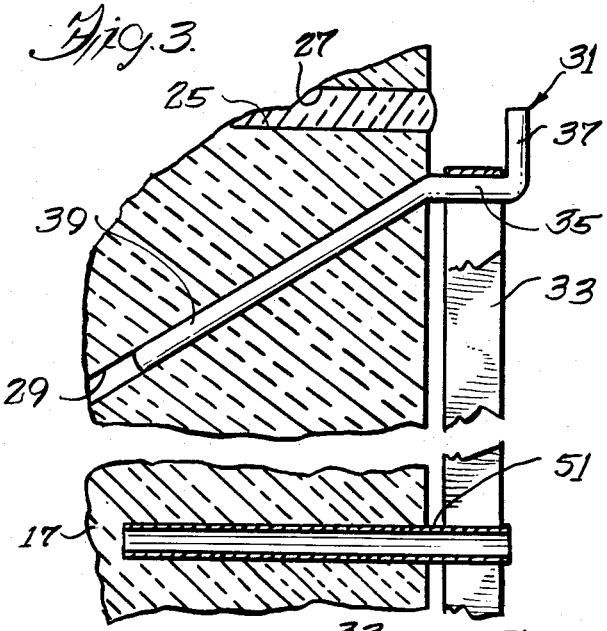
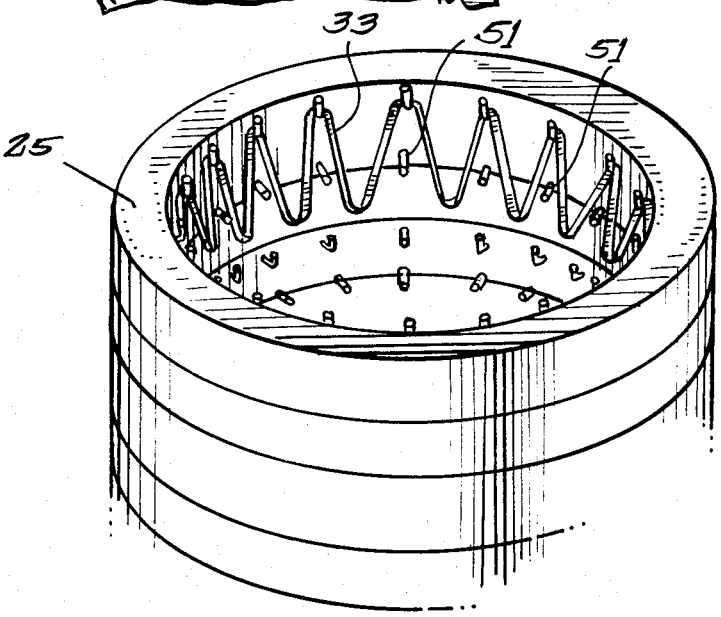
Fig 4.

ELECTRIC FURNACE INSULATION

The present invention relates to electric resistance heated furnaces and more particularly to an electric furnace of circular cross section having an insulated wall structure which supports electrical resistance ribbon heating elements.

BACKGROUND OF THE INVENTION

Electric-heated furnaces, such as those commonly used for annealing, generally heat the central furnace cavity by employing electric resistance heating elements in the form of long ribbons arranged in a serpentine pattern. The furnace will normally have an outer metal casing and, immediately interior of that casing, an insulated region. In earlier days, it was the practice to form this insulating region from firebrick or other such refractories and to then secure heater hanger supports between adjacent courses of firebrick.

More recently, electric furnaces have used ceramic fiber materials for wall insulation, and in some instances have extended support hooks completely through this insulation and attached them to the outer casing. Still more recently, such a direct heat path to the outer casing has been avoided when using ceramic fiber by the use of a construction such as that shown in U.S. Pat. No. 4,088,825, issued May 9, 1978. In this construction, anchors of matallic or ceramic construction are provided as such electric heater hangers for use with an insulating wall formed from a plurality of layers of ceramic fiber batts which are compressibly stacked, one atop another, contiguous to the outer casing. The anchors include supporting hooks and are located between pairs of adjacent ceramic fiber batts so that the hooks project the desired distance inwardly from the interior face of the insulation to support the electric heating element ribbons. Although such a construction provides improvement in reducing the time which it takes workers to re-line an electric furnace, compared to the removal and replacement of firebrick, still further improvements in electric furnace installation have continued to be sought.

SUMMARY OF THE INVENTION

The invention provides an improved electric furnace construction for furnaces of circular cross section and relatively standard dimensions. Prefabricated rings of ceramic fibers bonded together with an inorganic binder are formed as rigid bodies that are fashioned as integral pieces and can be easily handled. Some of these rings are provided with protruding metal hangers at predetermined desired locations, spaced around the interior circumference of the ring. The metal hangers are each formed with an upturned hook at one end of a short intermediate section that supports the heating ribbon and with a straight, elongated section at the other end thereof which is oriented at an angle of between about 115° and about 155° thereto. The elongated ends fit into downwardly inclined holes which are correspondingly oriented at an angle of between 25° and 65° to the interior, vertical, circumferential wall of the ring. Additional rigid ceramic fiber rings without hangers are located either above or below a hanger-carrying ring. A relatively thin sealing batt of flexible refractory fiber felt is preferably located at the interface between adjacent rings to insulate these regions, and optional ceramic spacers may be installed in the completed furnace arrangement.

BRIEF DESCRIPTION OF THE DRAWINGS

FIG. 1 is a perspective view of a rigid ceramic fiber ring which has been provided with a plurality of holes adapted to accept a plurality of metal hangers;

FIG. 2 is a vertical sectional view taken through an electric furnace embodying various features of the invention;

FIG. 3 is a fragmentary view similar to FIG. 2, enlarged in size, showing the insulation wall of a furnace which utilizes the optional ceramic spacers; and FIG. 4 is a perspective view looking into an electric furnace of the type illustrated in FIG. 3 with the exterior casing removed.

DETAILED DESCRIPTION OF THE PREFERRED EMBODIMENT

Generally in accordance with the present invention, there is shown in FIG. 2 a vertical cross section view of an electrically heated furnace 11 having an outer wall 13 in the form of a metal casing, which may be made of high-temperature resistant steel about 3/16 to ½-inch thick. The metal casing 13 is in the form of a tube of right circular cylindrical shape, fitted at its bottom with a refractory base or hearth 15 of conventional design. For purposes of illustration, a furnace of the type which has been sold under the tradename Homocarb is shown. This furnace was designed for firebrick insulation, and inasmuch as ceramic fiber insulation has superior insulating value, redesign of the furnace insulation resulted in a wall of lesser thickness.

The insulating walls are provided by a plurality of rigid rings 17,19 formed of ceramic fiber material bonded together with an inorganic binder to provide a rigid form-retaining body. These insulation rings 17,19 can be made by a vacuum-forming procedure, as generally taught in U.S. Pat. No. 4,122,644 to Woodruff, the disclosure of which is incorporated herein by reference. For example, a suitable felting box or mold having a felting screen at its bottom can be submerged in a ceramic fiber aqueous slurry while a vacuum is used to withdraw water through a bottom screen to cause the build-up of the layered mat of a desired thickness within the mold. The aqueous slurry contains a colloidal inorganic binder, and sufficient of the binder remains with the wet fibers to rigidly interconnect the fibers at their points of contact with one another following evaporation of the remainder of the water, which generally occurs during heating of the wet body in a recirculating oven or the like.

The ceramic fibers can be formed from inorganic oxides or the like, such as silica, zirconia, alumina, berylia, titania and mixtures thereof. Alumina-slicate fibers are commonly used, such as those available under the trademark Fiberfrax from the Carborundum Company, which have an approximate composition, by weight: aluminum oxide 51.3%, silicon dioxide 47.2%, boron oxide 0.5% and sodium oxide 0.15%, with the remainder being trace inorganics. If very high temperature operations are contemplated, a minor percentage of alumina fibers may be included, such as those sold under the trademark Saffil which contain about 95% alumina.

Colloidal silica, which is commercially available as an aqueous dispersion of small spherical particles of silicon dioxide that are negatively charged, is the preferred inorganic binder. However, similar aqueous dispersions of other colloidal particles, such as colloidal alumina or colloidal particles, may be used. Colloidal silica is commercially available as an aqueous dispersion in amounts up to about 50% by weight of silica, and this feature plus its relatively inexpensive price, makes it attractive for use in mass production operations.

Two types of insulation rings are provided, support rings 17 and filler rings 19. Both rings have the same interior diameter and exterior diameter, as can be seen from FIG. 2, and when installed in the furnace 11, both the interior cylindrical surfaces and the exterior cylindrical surfaces 23 are vertical. Furthermore, the rings each have a flat upper surface 25 and a flat parallel lower surface 27 both of which are horizontal in the installed position in the furnace. The main difference between the rings 17 and 19 is that the support rings 17 contain a series of downwardly inclined holes at uniformly spaced-apart locations about the interior surface 21. These holes 29 are provided to accommodate support rods 32 which serve as hangers for the electrical resistance heating elements or ribbons 33.

The holes can be formed as a part of the felting of the rings, if desired, as by providing removable pins or the like extending inward and downward from the interior surface of the mold wherein the felting operation takes place. On the other hand, all of the rings 17 and 19 can be formed in the same fashion, and the holes 29 can be created after the inorganic binder has set and the rings have become rigid. For example, the rigid ring can be placed in a jig, and the desired number of uniformly spaced holes can be drilled at the desired downwardly inclined angle from the interior surface 21. The support rods 31 are preferably formed from metal rod of circular cross section made of a suitable high-temperature resistant alloy. Each of the rods 31 is uniformly formed to have three sections. A relatively short intermediate section 35 serves as the hanger to support the electrical heating ribbon 33, at one end of which there is a short upturned hook section 37. An elongated end section 39 is provided at the other end thereof which is received in the hole 29 in the support ring 17, thus positioning the support rod 31 in its operative position, as best seen in FIG. 3.

The size of the rings 17,19 is proportioned to the particular furnace wherein they will be employed so as to position the electric heating ribbons 33 in essentially the same radial location where they would have been positioned when the furnace was originally insulated with firebrick. Because of the higher insulating qualities of the ceramic fiber rings, the radial thickness of the rings can be less than the thickness of firebrick previously needed to provide equivalent insulation performance. Accordingly, as seen in FIG. 2, the exterior surface 23 of the rings will be spaced inwardly from the outer casing 13 of the furnace, and an annular region 41 which is created as preferably filled with loose fibrous insulation 43. Although loose ceramic fibers can be employed, the termperature of this region will be lower than the temperature to which the interior surface 21 of the rings will be exposed, and accordingly mineral wool insulation 43 can be used in this region because of the lower temperature environment.

A top ring or curb 45 is disposed at the top of the furnace 11. The top ring 45 has a greater radial thickness than any of the other rings; however, it also has a larger internal diameter. The top ring 45 is made in a similar manner to the other rings, i.e., of ceramic fiber bonded by colloidal silica or the like, and extends from the interior wall of the metal casing 13 inward to a location intermediate of the interior and exterior surfaces of the support rings 17. As a result, the top ring 45 closes off the upper end of the annular region 41 wherein the loose mineral wool 43 is disposed and also provides an enlarged entrance downward into the cavity of the furnace 11. Preferably, the upper edge of the interior surface of the curb is chamfered to provide an outward taper 47 that facilitates the insertion of a plug (not shown) which is employed during heating operations and which can include a lid for a tubular metal retort (not shown) included within the furnace cavity.

As indicated above, the rings are sized so as to locate the electric resistance heating ribbons 33 in the desired radial location with respect to the furnace cavity. For a furnace 11 having a metal casing 13 about 59 inches in diameter, the interior diameter of the rings 17,19 might be about 36 inches with a radial thickness of about 6 inches, leaving an outer annular region 41 for filling with mineral wool about 5 to 6 inches in radial thickness. The cavity in this furnace could accommodate a sealable metal retort of about 27 inches in diameter. For a larger diameter furnace having a shell of about 76 inches in diameter, the rings 17,19 might have an interior diameter of about 52 inches and again a wall thickness of about 6 inches, creating a similarly sized annular region in this furnace construction, which could accommodate a retort of about 44 inches in diameter.

The height of the retort may vary in different furnaces of the same diameter casing. As an example, the installation of the insulation system in a furnace 11 having a retort about 48 inches high is hereinafter described, which furnace 11 would usually have an outer casing 13 about 66½ inches in diameter. A lowermost spacer ring **19*a* having an I.D. of 41 inches and an O.D. of 53 inches is initially positioned on the hearth 15 coaxial with the centerline of the furnace. A layer 27 of flexible ceramic fiber felt about six inches wide and having an uncompressed thickness of about one inch is positioned to completely cover the upper surface of the lowermost spacer ring, the height of which ring is three inches. A second spacer ring 19*b* having a height of about 7½ inches is located atop the lowermost spacer ring, and its upper surface is similarly covered with a layer of ceramic fiber felt 27**.

A first support ring **17*a* is located next above this second spacer ring. The support ring carries 54 support rods 31 spaced uniformly around the interior circumference of the ring at intervals of about 2⅜ inches. Another layer of flexible felt 27 is laid atop the upper surface of the support ring 17*b*, and then a third filler ring 19*c*, another layer of flexible felt and a second support ring 17*b* are located thereatop. Finally the insulation system is completed with two more layers of flexible felt, a filler ring 19*d* about 4½ inches high and a fourth support ring 17*c*. The annular region 43 between the exterior surface 23 of the rings and the interior of the metal casing 13 is then filled by tamping loose mineral wool thereinto. The installation of the top curb renders the system ready for hanging of the electrical ribbon heaters 33**, which are depicted in ghost outline.

As a result of the use of three identical support rings 17 at different levels, the insulation system will support three separate ribbon heaters 33 arranged in serpentine fashion at three different vertical levels about the wall of the furnace. Each of the intermediate hanger portions 35 of the rod measures about one inch, and the upturned hook portion 37 at the interior end thereof is also about one inch in length. The elongated end 39 of the rods are about 4 inches in length, and this portion lies at about an angle 150° to the intermediate hanger portion 35. The ribbon electric resistance heating elements 33 are about one inch wide, and each has a length of about 73 feet to provide the serpentine arrangement at each vertical level within the furnace. The individual loops of the serpentine ribbon arrangement may hang down about ten inches below the intermediate hanger section 35.

Optional spacers 51 preferably made of a ceramic or porcelain material can be provided vertically below each of the hangers 31 to prevent any inadvertent touching of the adjacent loops of the ribbon heater 33. These ceramic spacers 51 may be short lengths of ceramic tubing, e.g. 5½ inches long. There is no stress or load on these ceramic spacers 51, and accordingly it is acceptable to insert them directly horizontally into holes formed in the insulation system where they can be secured by refractory cement.

Furnaces of this type may operate at temperatures of about 2000° F. within the furnace cavity without reaching unacceptable temperatures at the metal casing. Should there be a desire to achieve even higher temperatures, insulating rings 17,19 of greater radial thickness could be used, as the rings have a greater "R"-value than does the mineral wool and thus even higher temperatures could be safely achieved within a furnace of these general dimensions. If higher temperatures were used, it might also be desirable to employ ceramic rods 31 which might be suitable pressed from alumina or a like material. Because these ceramic fiber rings have high insulation ratings, the overall efficiency of the furnace 11 is improved, and further improvement comes from the fact that cool-down and heat-up characteristics are enhanced because these rings store much less thermal energy than conventional firebrick.

Although the invention has been described with regard to certain preferred embodiments, which constitute the best mode presently known to Applicant, it should be understood that various modifications and changes as would be obvious to one having the ordinary skill in this art may be made without departing from the scope of the invention which is defined solely by the claims appended hereto. Particular features of the invention are emphasized in the claims which follow.

What is claimed is:

1. An electric resistance heated furnace which comprises an outer shell having a top opening for access to the interior thereof, a plurality of prefabricated, form-retaining, self-supporting, integral insulation rings made of ceramic fibers bonded together with an inorganic binder to form a rigid one-piece body having substantially flat top and bottom surfaces and cylindrical interior and exterior surfaces, at least some of said integral rings having a plurality of holes provided therein which extend generally radially outward from said interior surface at circumferentially uniformly spaced-apart points, said holes being disposed so that the centerlines thereof are downwardly inclined from said interior surface and oriented at an angle of between about 25° and about 65° thereto, said integral rings having an outer diameter less than the inner diameter of said shell and being spaced therefrom to provide an annular region therebetween, said rings being stacked vertically one atop another with the interior surfaces thereof defining a cylindrical furnace cavity and with each said integral ring supporting the weight of the overlying rings, fibrous insulation within said annular region, a plurality of high-temperature-resistant hangers each having a straight, elongated end section disposed in one of said holes, a short intermediate section formed at an angle of between about 115° and about 155° to said elongated end section, and an upturned interior end section at the other end of said intermediate section, and electric resistance ribbon heating elements hanging in depending loops from said intermediate sections.

2. A furnace in accordance with claim 1 wherein a plurality of said integral insulation rings are provided which do not have such holes and which serve as spacers, being disposed either above or below one of said insulation rings containing said holes.

3. A furnace in accordance with claim 2 wherein each of said hole-containing insulation rings has a vertical height greater than its radial thickness.

4. A furnace in accordance with claim 3 wherein each of said spacer rings has a vertical height less than its radial thickness.

5. A furnace in accordance with claim 1 wherein said hangers are formed from metal alloy rod of circular cross section.

6. A furnace in accordance with claim 2 wherein a layer of flexible ceramic fiber felt is disposed between the top and bottom surfaces of adjacent rings.

7. A furnace in accordance with claim 6 wherein ceramic spacers are provided to prevent said loops of said ribbon heating elements from touching one another.

8. An insulation and heater mounting system for use in an electric resistance heated furnace, which system comprises a plurality of prefabricated, form-retaining, self-supporting, integral insulation rings made of ceramic fibers bonded together with an inorganic binder to form a rigid one-piece body having substantially flat top and bottom surfaces and cylindrical interior and exterior surfaces, at least some of said integral rings having a plurality of holes provided therein which extend generally radially outward from said interior surface at circumferentially uniformly spaced-apart points, said holes being disposed so that the centerlines thereof are downwardly inclined from said interior surface and oriented at an angle of between about 25° and about 65° thereto, said rings being adapted to be stacked vertically one atop another so that the interior surfaces thereof define a cylindrical furnace cavity with each said integral ring supporting the weight of the overlying rings in the stack, and a plurality of high-temperature-resistant hangers each having a straight, elongated end section proportioned to be received in one of said holes, a short intermediate section formed at an angle of between about 115° and about 155° to said elongated end section, and an upturned interior end section at the other end of said intermediate section, said intermediate sections being adapted to support electric resistance ribbon heating elements which will hang in depending loops therefrom.

9. A system in accordance with claim 8 wherein a plurality of said integral insulation rings are provided which do not have such holes and which are designed to serve as spacers disposed either above or below one of said insulation rings containing said holes.

10. A system in accordance with claim 8 wherein said hole-containing insulation rings have a vertical dimension between the top and bottom surfaces greater than the radial dimension thereof.

11. A system in accordance with claim 10 wherein said spacer rings have a vertical dimension less than the radial dimension thereof.

12. A system in accordance with claim 8 wherein said hangers are formed from metal alloy rod of circular cross section.

13. In an electric resistance heated furnace, an insulation and heater mounting system, which comprises a plurality of prefabricated, form-retaining, self-supporting, integral insulation rings made of ceramic fibers bonded together with an inorganic binder to form a rigid one-piece body having substantially flat top and bottom surfaces and cylindrical interior and exterior surfaces, at least some of said integral rings having a plurality of holes provided therein which extend generally radially outward from said interior surface at circumferentially uniformly spaced-apart points, said holes being disposed so that the centerlines thereof are downwardly inclined from said interior surface and oriented at an angle of between about 25° and about 65° thereto, said rings being stacked vertically one atop another with the interior surfaces thereof defining a cylindrical furnace cavity and with each said integral ring supporting the weight of the overlying rings, and a plurality of high-temperature-resistant hangers each having a straight, elongated end section proportioned to be received in one of said holes, a short intermediate section formed at an angle of between about 115° and about 155° to said elongated end section, and an upturned interior end section at the other end of said intermediate section, each of said holes containing said elongated end of one of said hangers so that said intermediate sections are adapted to support electric resistance ribbon heating elements which will hang in depending loops therefrom.

14. A system in accordance with claim 13 wherein a plurality of said integral insulation rings are provided which do not have such holes and which serve as spacers being disposed either above or below one of said insulation rings containing said holes.

15. A system in accordance with claim 14, wherein said hole-containing insulation rings each have a vertical height greater than its radial thickness.

16. A system in accordance with claim 15 wherein each of said spacer rings has a vertical height less than its radial thickness.

17. A system in accordance with claim 13 wherein said hangers are formed from metal alloy rod of circular cross section.

18. A system in accordance with claim 13 wherein said hangers are formed from alumina.

* * * * *

UNITED STATES PATENT AND TRADEMARK OFFICE

CERTIFICATE OF CORRECTION

PATENT NO. : 4,493,089

DATED : January 8, 1985

INVENTOR(S) : R. Bruce Abell

It is certified that error appears in the above-identified patent and that said Letters Patent is hereby corrected as shown below:

Front of patent, Name of Assignee:

Correct the spelling of "Products".

Column 1, line 42, change "installation"

to --insulation--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*